US008496509B2

(12) United States Patent
Faecher

(10) Patent No.: US 8,496,509 B2
(45) Date of Patent: Jul. 30, 2013

(54) VOICE ACTIVATED BUBBLE BLOWER

(75) Inventor: Bradley S. Faecher, Sudbury, MA (US)

(73) Assignee: What Kids Want, Inc., Northridge, CA (US)

( * ) Notice: Subject to any disclaimer, the term of this patent is extended or adjusted under 35 U.S.C. 154(b) by 302 days.

(21) Appl. No.: 12/890,438

(22) Filed: Sep. 24, 2010

(65) Prior Publication Data

US 2011/0081820 A1 Apr. 7, 2011

Related U.S. Application Data

(60) Provisional application No. 61/247,912, filed on Oct. 1, 2009.

(51) Int. Cl.
*A63H 33/28* (2006.01)

(52) U.S. Cl.
USPC ..... 446/15; 446/175

(58) Field of Classification Search
USPC ..... 446/15–22, 175
See application file for complete search history.

(56) References Cited

U.S. PATENT DOCUMENTS 5,419,728 A * 5/1995 Dallara ..... 446/15
5,478,267 A * 12/1995 McDonald et al. ..... 446/15
5,540,608 A * 7/1996 Goldfarb ..... 446/15
6,102,764 A 8/2000 Thai
6,139,391 A 10/2000 Thai et al.
6,152,358 A * 11/2000 Bryan ..... 229/87.19
6,331,130 B1 12/2001 Thai
6,394,872 B1 5/2002 Watanabe et al.
6,416,377 B1 * 7/2002 Bart ..... 446/15
6,544,091 B1 4/2003 Thai
6,616,498 B1 9/2003 Thai
6,620,015 B2 9/2003 Thai
6,620,016 B1 9/2003 Thai
6,647,927 B1 * 11/2003 Werde et al. ..... 119/711
6,659,830 B2 12/2003 Thai
6,659,831 B2 12/2003 Thai
6,755,710 B2 6/2004 Thai
6,786,251 B2 * 9/2004 Nadel et al. ..... 141/98
6,857,928 B2 2/2005 Thai
6,905,386 B2 6/2005 Thai
6,921,312 B2 7/2005 Thai
7,008,287 B2 3/2006 Thai
7,476,139 B2 * 1/2009 Thai ..... 446/15
8,087,968 B2 * 1/2012 Amron ..... 446/15
2002/0073585 A1 * 6/2002 Burnett ..... 40/406
2002/0094746 A1 * 7/2002 Harlev ..... 446/178

(Continued)

OTHER PUBLICATIONS

University of Massachusetts Lowell, Assistive Technology Program, Department of Electrical & Computer Engineering, http://atp.caeds.eng.uml.edu/project%202004.htm, accessed Oct. 7, 2010.

(Continued)

*Primary Examiner* — Gene Kim
*Assistant Examiner* — Urszula M Cegielnik
(74) *Attorney, Agent, or Firm* — SoCal IP Law Group LLP; Mark A. Goldstein

(57) ABSTRACT

There is disclosed a bubble generating apparatus including a body portion, a bubble ring, a blower and a sound sensor. The bubble generating apparatus is designed to generate bubbles in response to sounds detected by the sound sensor. When sound is detected by the sensor, the blower is activated thereby directing air through the bubble ring in response to those sounds.

11 Claims, 3 Drawing Sheets

U.S. PATENT DOCUMENTS

| | | | | |
|---|---|---|---|---|
| 2005/0106991 | A1* | 5/2005 | Marine et al. | 446/296 |
| 2005/0282461 | A1 | 12/2005 | Thai | |
| 2006/0052028 | A1 | 3/2006 | Thai | |
| 2006/0116048 | A1* | 6/2006 | Choi | 446/15 |
| 2006/0223409 | A1* | 10/2006 | Chernick et al. | 446/15 |
| 2007/0207700 | A1* | 9/2007 | Ellis | 446/484 |
| 2007/0259594 | A1* | 11/2007 | Galbiati et al. | 446/15 |
| 2008/0104869 | A1* | 5/2008 | Wang | 40/406 |
| 2009/0093183 | A1* | 4/2009 | Randle et al. | 446/175 |

OTHER PUBLICATIONS

Daiya, Gun, Tin (Daiya), http://www.bubbleblowers.com/pages/87.html, accessed Oct. 7, 2010.

Exelo, Gun, Tin (Exelo), http://www.bubbleblowers.com/pages/41.html, accessed Oct. 7, 2010.

* cited by examiner

VOICE ACTIVATED BUBBLE BLOWER

RELATED APPLICATION INFORMATION

This patent claims priority from provisional patent application No. 61/247,912 filed Sep. 1, 2009, entitled Voice Activated Bubble Blower.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to bubble blowing devices, and in particular a voice activated bubble blowing device.

2. Description of Related Art

There are various types of bubble generating apparatus. Bubble generating apparatus typically provide a bubble ring incorporating a series of ridges and a handle. Other apparatus are much larger for generating larger bubbles or are very small for ease in transporting the apparatus.

DETAILED DESCRIPTION

Figure 1:
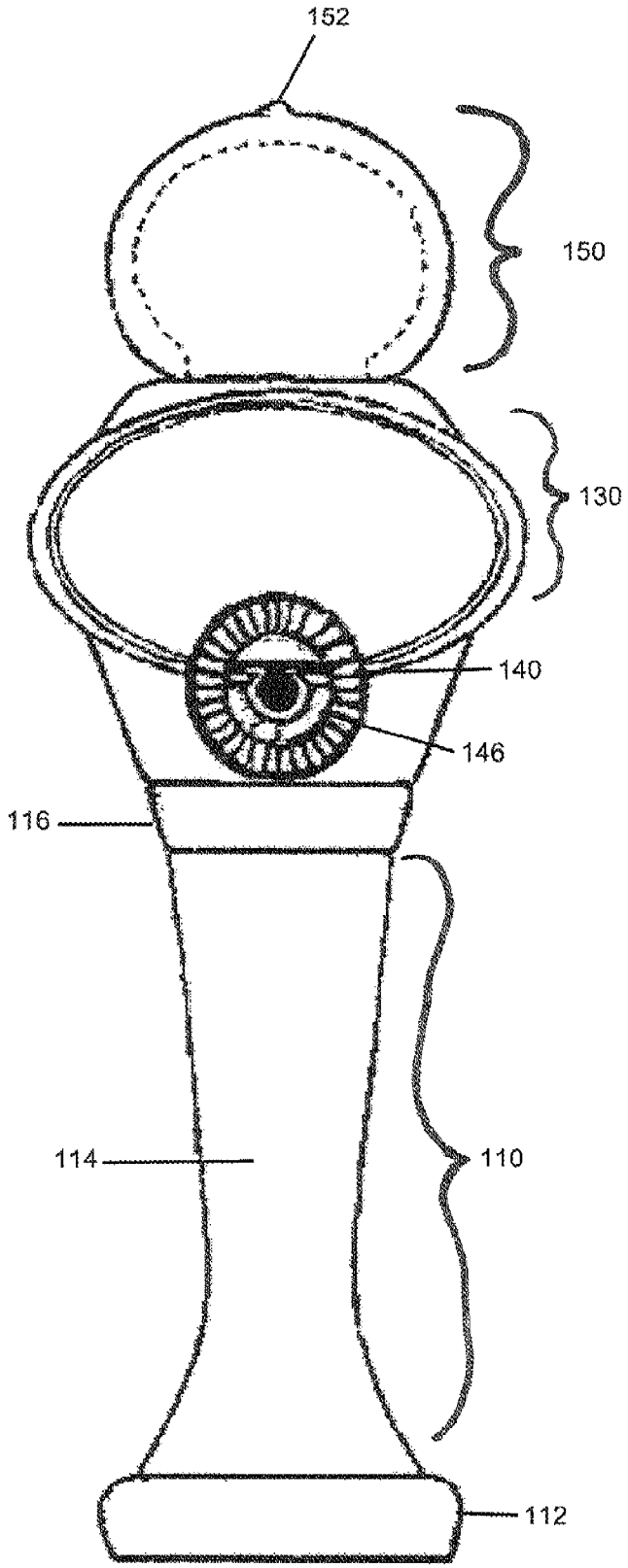
FIG. 1 is a front view of a bubble generating assembly.
Figure 2:
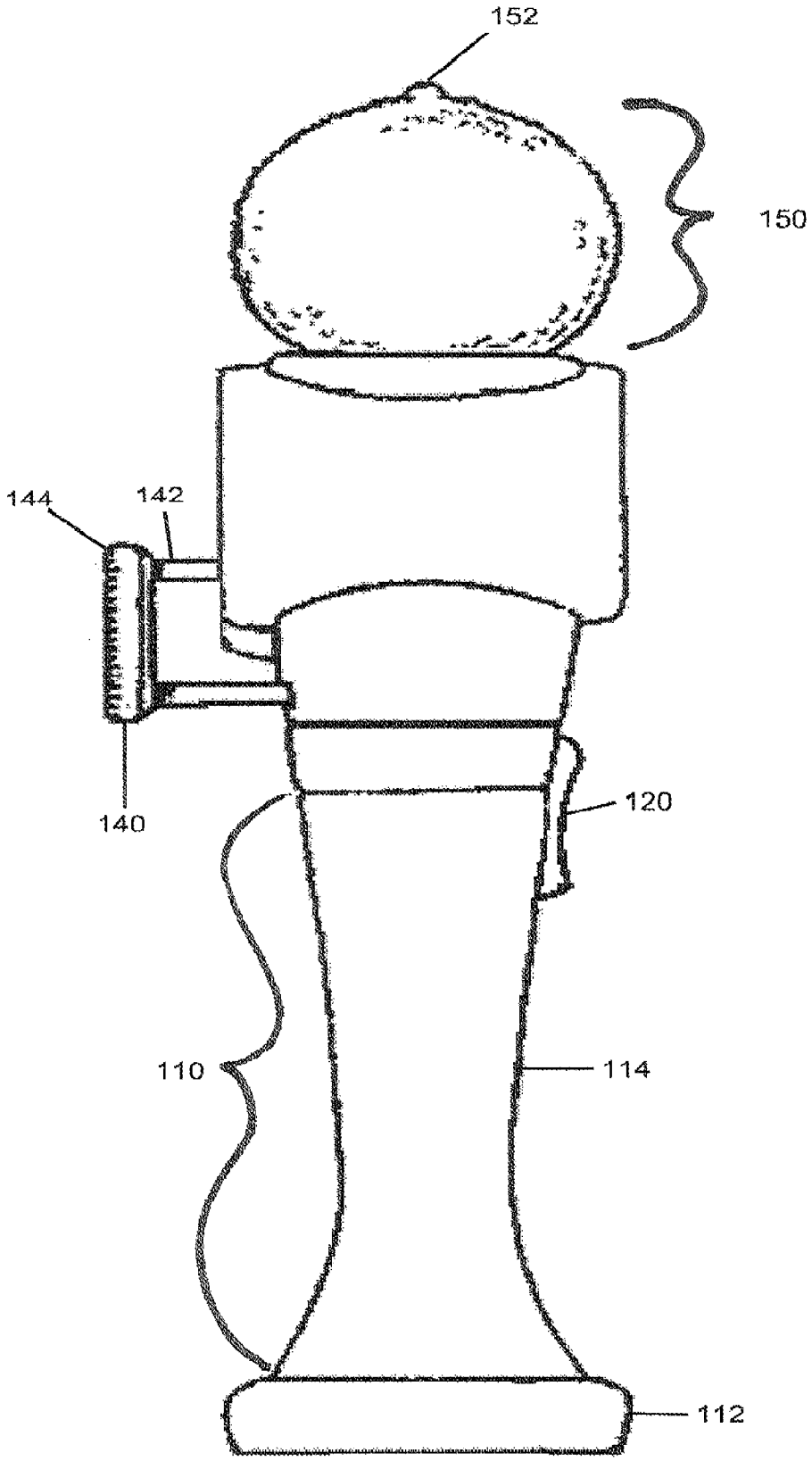
FIG. 2 is a side view of a bubble generating assembly.
Figure 3:
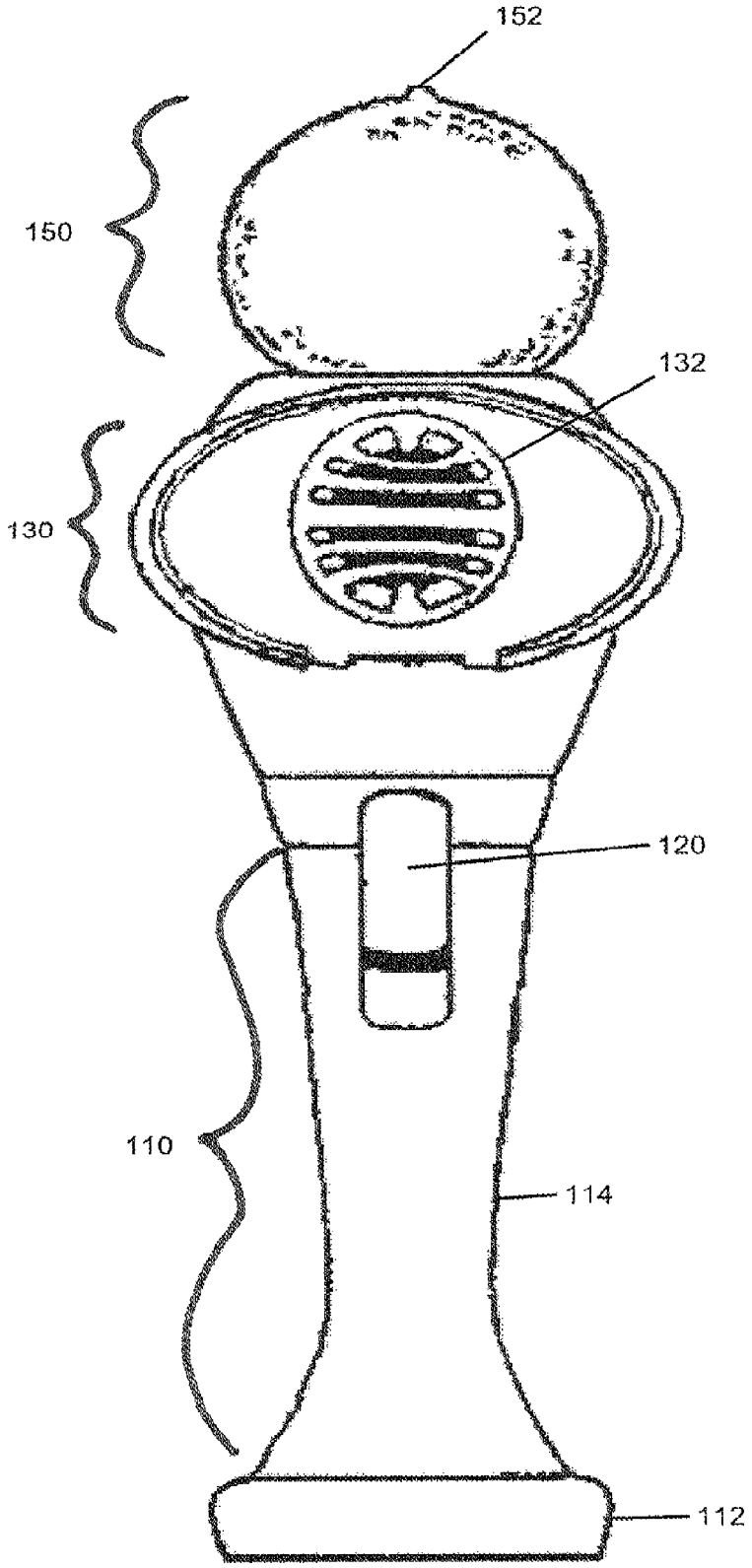
FIG. 3 is a back view of a bubble generating assembly.

With reference to FIGS. 1-3 throughout, a bubble generating assembly 100 is shown. The bubble generating assembly 100 may be made out of resilient plastic or other suitably resilient material. The bubble generating assembly 100 resembles a hand held microphone. The bubble generating assembly 100 creates bubbles of different shapes and sizes in response to recognizing or sensing a human voice.

The bubble generating assembly 100 has a tapered cylindrical handle 110 that may taper out towards the bottom where there is a base portion 112 and minimally taper out toward the top where there is an upper portion 116. The base portion 112 may be generally rounded and may be permanently coupled to or integrated with the lower portion of the main portion 114 of the handle 110. The handle 110 may also include an upper portion 116 that may be coupled with or integrated with the main portion 114. The handle 110 is constructed so that a user can extend his or her fingers to grip the main portion 114 allowing the handle 110 to be held easily by a human hand.

The handle 110 also includes an on/off switch 120 which is connected to a power source to allow the user to place the bubble generating assembly 100 in an on or off state. The switch 120 may be a slider, pressure sensitive button, and others. A portion of the switch may be internal to the handle 110 and coupled, using wires or other conductive materials, with the blower and the power source and the sensor. The power source is contained in the handle 110. The power source may be a battery. The battery compartment in the handle may be covered by a cap and secured to the handle by a screw or other fastener. The battery may be permanent and not removable or may be removable and replaceable.

A transitionary piece sits on top of the handle in the form of an elliptic cylinder 130. The elliptic cylinder 130 houses an air intake grill 132 to allow air in to a blower or fan which pushes and directs the air out through an air channel opening 146. The blower blows a stream of air that is directed through an air channel opening towards the bubble ring 140. The air stream is blown out from the air channel through the air channel opening which is located on the side of the elliptic cylinder 130 opposite the air intake grill 132.

A bubble ring 140 is positioned adjacent to the front opening of the air channel 146 on one side of the elliptic cylinder surface and is aligned with the air channel opening 146. The bubble ring 140 is a bubble producing piece that may include a single loop. The bubble ring 140 may include a plurality of loops. The single or plurality of loops may be circular or may be other shapes including elliptical, star, cloud, and others. The bubble ring 140 is coupled to the area around the air channel 146 opening and secured to the housing by two or more legs 142 in the form of cylinders. The legs 142 of the bubble ring 140 are coupled with, attached to or molded from the elliptic cylinder 130 and may also be coupled with an upper portion or extension of the cylinder handle 110. The legs 142 mount or attach the bubble ring 140 to the elliptic cylinder 130.

The legs 142 may be of a length so that the bubble ring 110 is a sufficient distance from the air channel opening 146 to allow for bubbles to be created by the bubble ring when the blower produces a stream of air. The legs may be the same or different lengths. The legs 142 may be spaced apart in an equidistant manner from each other on the bubble ring, or may be placed at any desired spacing along the circumference of the bubble ring. Any number (i.e., one or more) of legs 142 may be used.

The bubble ring 140 has optional ridges 144 that are arranged around the ring and designed to help hold a film of a bubble solution covering the ring. The bubble ring 140 may be serrated such that ridges or bumps 144 are provided on the outer circumferential surface and/or inner circumferential surface of the bubble ring 140. The ridges 144 function to better hold the bubble solution against the bubble ring 140 and to form a film of bubble solution. The stream of air generated by the blower travels through the film of bubble solution sitting on the bubble ring 140, thereby creating bubbles.

On top of the elliptic cylinder 130 is a generally spherical head 150. An aperture 152 is located on top of the spherical head 150 to allow a voice or sound sensor included inside the spherical head to receive the sounds. The sound sensor is connected to the power source, using wires or other conductive materials. The sound sensor sits inside the spherical head 150. The spherical head 150 may be constructed to resemble a microphone head having a surface that may be a dimple design, mesh design, smooth, web-like pattern or other construction.

The handle 110, elliptic cylinder 130 and spherical head 150 may be formed from two symmetrical outer shells so as to house the internal components of the assembly, namely the power source, sound sensor, switch, and blower. The housing may be provided in the form of two symmetrical outer shells that are connected together by, for example, screws, friction fit, glue, or other means. These outer shells together define a hollow interior for housing the internal components of the assembly. In one embodiment, the spherical head 150 may be a component separate from the handle 110 and elliptic cylinder 130.

The bubble generating assembly 100 is used by a person placing the switch into an on position, dipping the bubble ring 140 into bubble solution so that the bubble ring 140 is coated with bubble solution, and then speaking or singing into the spherical head 150. By doing so, the sound sensor is activated which triggers the blower to blow, creating a stream of air through the air channel, the air contacting and passing through the bubble ring 140 to produce bubbles from the bubble ring 140. The bubble solution can be held in a dish or tray (not shown), and any conventional bubble solution can be used.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A bubble generating apparatus comprising:

a body resembling a hand held microphone, the body including, from bottom to top, a base, a handle, an elliptic cylinder and a head;

a bubble ring, affixed to the elliptic cylinder to generate bubbles;

an air intake grill, on the exterior of the elliptic cylinder to allow air to enter the elliptic cylinder;

an air channel opening on the exterior of the elliptic cylinder opposite the air intake gal and aligned with the bubble ring, the air channel opening to allow air to exit the elliptic cylinder;

a blower, housed within the elliptic cylinder to receive air through the intake grill and to direct air through the air channel opening toward the bubble ring; and a sound sensor housed within the head to detect sound through an aperture in a top of the head and activate the blower in response to detecting a human voice.

2. The apparatus of claim 1 further comprising a power source sources housed within the handle to provide power to the blower and the sound sensor.

3. The apparatus of claim 2 further comprising a power switch, accessible on the exterior of the handle to enable and disable access by the blower and the sound sensor to the power source.

4. The apparatus of claim 1 wherein the power source is housed within the handle.

5. The apparatus of claim 4 wherein the handle is removably attached to the base, and the power source is accessible by temporarily removing the base from the handle.

6. The apparatus of claim 1 wherein the bubble ring is affixed to the elliptic cylinder by a plurality of legs.

7. The apparatus of claim 6 wherein the plurality of legs provide space between the air channel opening and the bubble ring.

8. A bubble generating apparatus comprising:

a body including a base, a handle adjacent to the base, an elliptic cylinder adjacent to the handle, and a head adjacent to the elliptic cylinder;

a bubble ring, affixed to the elliptic cylinder to generate bubbles;

an air intake grill, on the exterior of the elliptic cylinder to allow air to enter the elliptic cylinder;

an air channel opening on the exterior of the elliptic cylinder opposite the air intake grill, the air channel opening to allow air to exit through the elliptic cylinder toward the bubble ring;

a blower housed within the elliptic cylinder to direct air through the air channel opening toward the bubble ring; and a sound sensor, housed within the head to detect sound through an aperture in a top of the head and activate the blower in response to detecting a human voice.

9. The bubble generating apparatus of claim 8 further comprising a power source, housed within the handle, to provide power to the blower and the sound sensor.

10. The bubble generating apparatus of claim 8 further comprising a power switch, accessible from the exterior of the body, to enable and disable access by the blower and sound sensor to the power source.

11. The apparatus of claim 8 wherein the power source is accessible by temporarily removing the base from the handle.

* * * * *

UNITED STATES PATENT AND TRADEMARK OFFICE

CERTIFICATE OF CORRECTION

PATENT NO. : 8,496,509 B2
APPLICATION NO. : 12/890438
DATED : July 30, 2013
INVENTOR(S) : Bradley S. Faecher It is certified that error appears in the above-identified patent and that said Letters Patent is hereby corrected as shown below:

In the Claims:

Column 4, line 12: delete “sources”.

Signed and Sealed this
Tenth Day of September, 2013

Teresa Stanek Rea
*Acting Director of the United States Patent and Trademark Office*